US008075341B2

(12) United States Patent
Su et al.

(10) Patent No.: US 8,075,341 B2
(45) Date of Patent: Dec. 13, 2011

(54) ELECTRICAL CABLE CONNECTOR ASSEMBLY WITH LESS EMI DURING SIGNAL TRANSMISSION

(75) Inventors: Ping-Sheng Su, Tu-Cheng (TW); Xiao-Li Li, Kunshan (CN)

(73) Assignee: Hon Hai Precision Ind. Co., Ltd., New Taipei (TW)

( * ) Notice: Subject to any disclaimer, the term of this patent is extended or adjusted under 35 U.S.C. 154(b) by 0 days.

(21) Appl. No.: 12/878,206

(22) Filed: Sep. 9, 2010

(65) Prior Publication Data

US 2011/0059646 A1 Mar. 10, 2011

(30) Foreign Application Priority Data

Sep. 9, 2009 (CN) ..... 2009 1 0306795

(51) Int. Cl.
*H01R 13/648* (2006.01)

(52) U.S. Cl. ..... 439/607.48; 439/607.5; 439/607.51

(58) Field of Classification Search ..... 439/607.48, 439/607.5, 607.51
See application file for complete search history.

(56) References Cited

U.S. PATENT DOCUMENTS

| | | | | |
|---|---|---|---|---|
| 6,109,969 | A | 8/2000 | Peter et al. | |
| 7,909,647 | B2 * | 3/2011 | Kawaguchi et al. | 439/585 |
| 2003/0104728 | A1 * | 6/2003 | Inagawa et al. | 439/610 |

* cited by examiner

*Primary Examiner* — Gary F. Paumen
(74) *Attorney, Agent, or Firm* — Wei Te Chung; Andrew C. Cheng; Ming Chieh Chang

(57) ABSTRACT

An electrical cable connector assembly comprises a metallic shell defining a receiving space and a rear wall enclosing the receiving space, a printed circuit board retained in the receiving space, an electrical connector including an insulative housing and a plurality of contacts retained in the insulative housing, and a cable located behind the printed circuit board and including a wire extending into the receiving space to be soldered on the printed circuit board. The contacts each defines a soldering tail soldered to the printed circuit board. Wherein the rear wall defines a cable ring deep drawn rearwardly therefrom to cover the cable.

18 Claims, 6 Drawing Sheets

ELECTRICAL CABLE CONNECTOR ASSEMBLY WITH LESS EMI DURING SIGNAL TRANSMISSION

BACKGROUND OF THE INVENTION

1. Field of the Invention

The present invention generally relates to an electrical cable connector assembly, and more particularly to an electrical cable connector assembly with less EMI during signal transmission.

2. Description of Related Art

With the development of communication and computer technology et al., electrical cable connector assembly for high-speed signal transmission is widely used in electronic systems. An electrical cable connector assembly is a kind of high-speed signal transmission connector which comprises an inner metallic shell defining a cavity, a printed circuit board retained into the cavity, an electrical connector, an insulative cover defining a receiving space accommodating the printed circuit board and the inner shell therein, and a cable extending rearwardly out of the inner shell and the cover. The electrical connector includes an insulative housing, and a plurality of contacts retained in the insulative housing. The insulative housing includes a body portion retained in the cavity of the inner shell, a mating portion protruding forwardly to exterior from the body portion. The printed circuit board is connected with the cable and the contacts of the electrical connector. The inner shell has a top wall, a pair of arc plates bending downwardly form a rear end of the top wall to form a cable ring therebetween. However, It can not reduce electromagnetic interference (EMI) during signal transmission via the cable ring of the shell covers the cable.

Correspondingly, it is desired to have an electrical cable connector assembly with improved structure to address the problems stated above.

BRIEF SUMMARY OF THE INVENTION

According to one aspect of the present invention, an electrical cable connector assembly comprises a metallic shell defining a receiving space and a rear wall enclosing the receiving space; a printed circuit board retained in the receiving space; an electrical connector including an insulative housing, and a plurality of contacts retained in the insulative housing, the contacts each defining a soldering tail soldered to the printed circuit board; and a cable located behind the printed circuit board and including a wire extending into the receiving space to be soldered on the printed circuit board, the cable extending rearwardly out of the shell; wherein the rear wall defines a cable ring deep drawn rearwardly therefrom to cover the cable.

According to one aspect of the present invention, an electrical cable connector assembly comprises a metallic shell defining a receiving space, and a cable ring extending rearwardly and aparted from the receiving space; an insulative cover defining a cavity accommodating the shell therein, and a rear wall enclosing the cavity; an electrical connector having an insulative housing, and a plurality of contacts retained in the insulative housing, the insulative housing defines a body portion retained in one of the receiving space and the cavity, and a mating portion protruding forwardly out of the insulative cover from the body portion; a cable including a plurality of wires electrically connected to the contacts, and a strain relief portion surrounding the wires; wherein the cable ring encloses the cable, the strain relief portion of the cable is sandwiched between the cable ring and the rear wall of the insulative cover for preventing the cable from moving along a front-to-rear direction.

Other objects, advantages and novel features of the invention will become more apparent from the following detailed description of the present embodiment when taken in conjunction with the accompanying drawings.

DETAILED DESCRIPTION OF THE INVENTION

Figure 1:
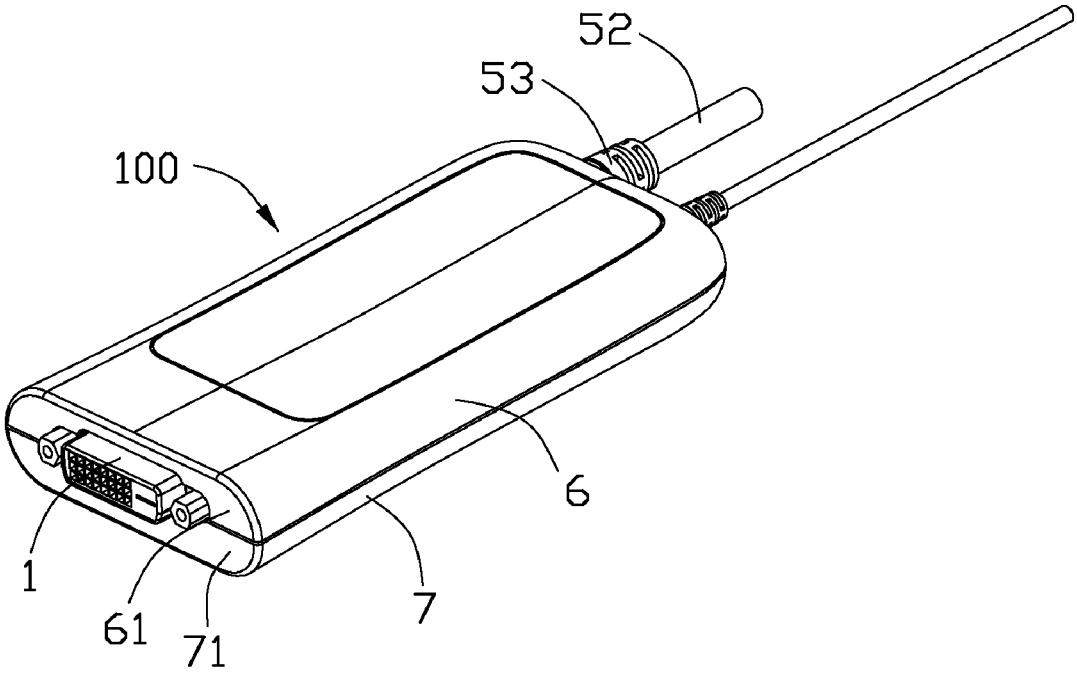
FIG. 1 is a perspective view of an electrical cable connector assembly in accordance with the preferred embodiment of the present invention.

Reference will now be made to the drawing figures to describe the present invention in detail.

Figure 2:
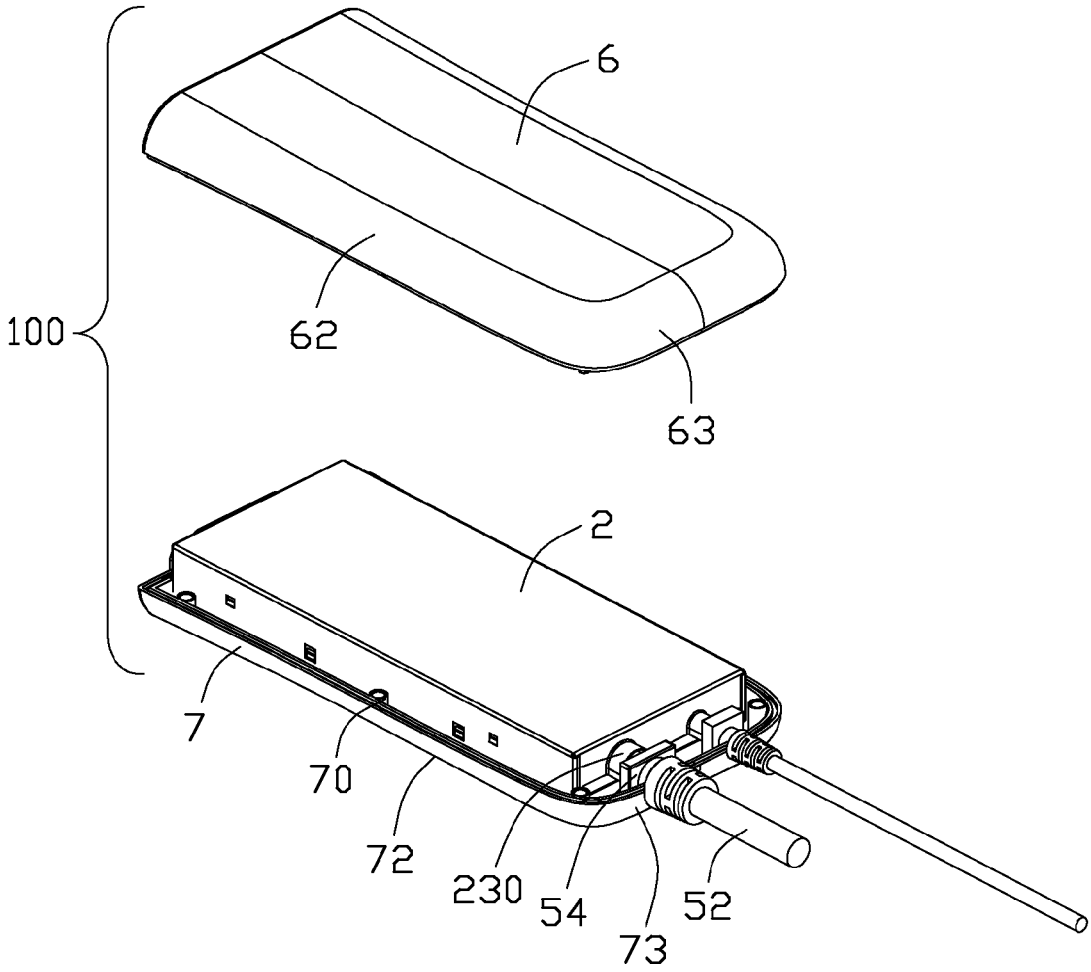
FIG. 2 is a partly exploded view of the electrical cable connector assembly shown in FIG. 1.
Figure 3:
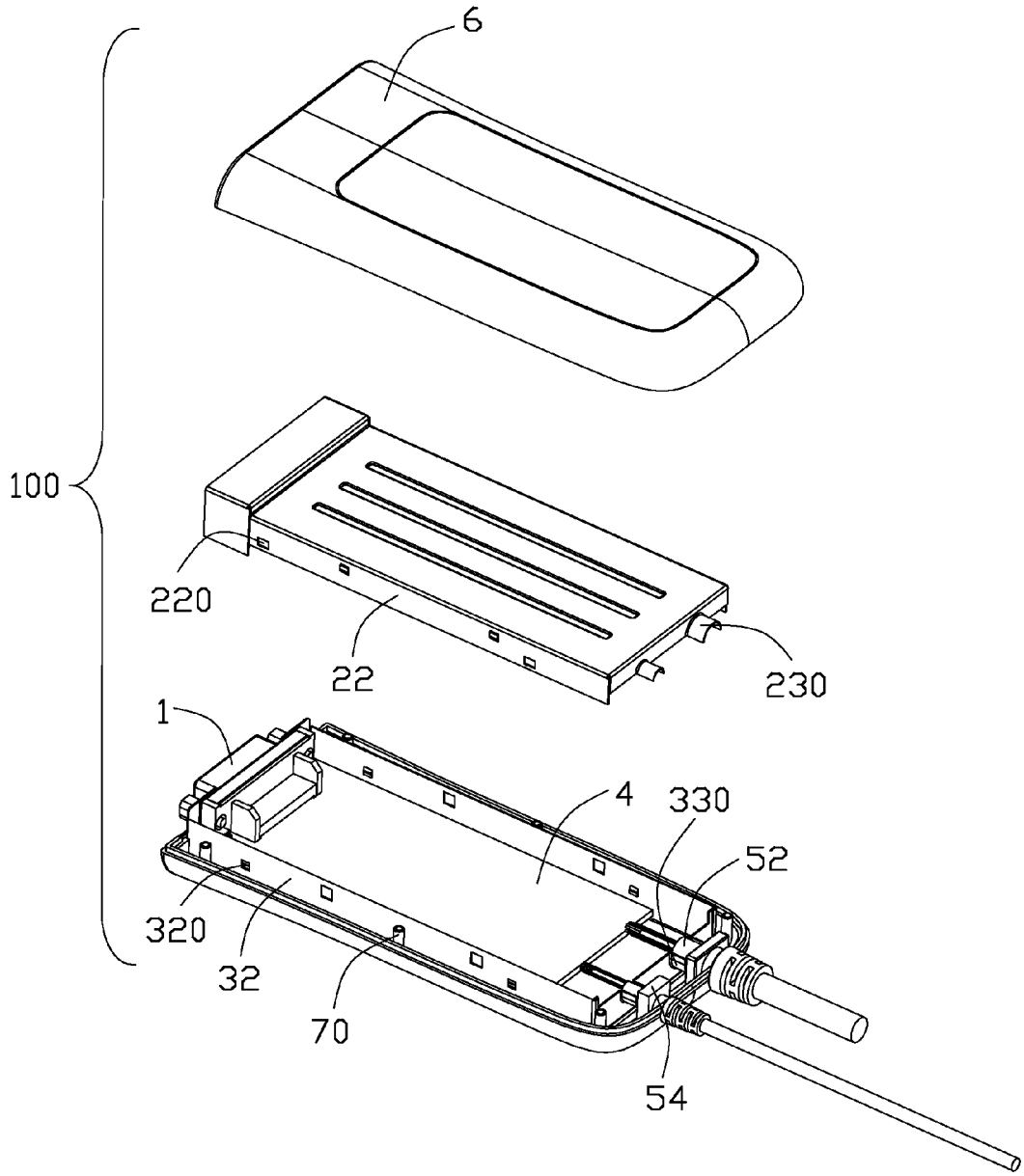
FIG. 3 is another partly exploded view of the electrical cable connector assembly shown in FIG. 1.
Figure 4:
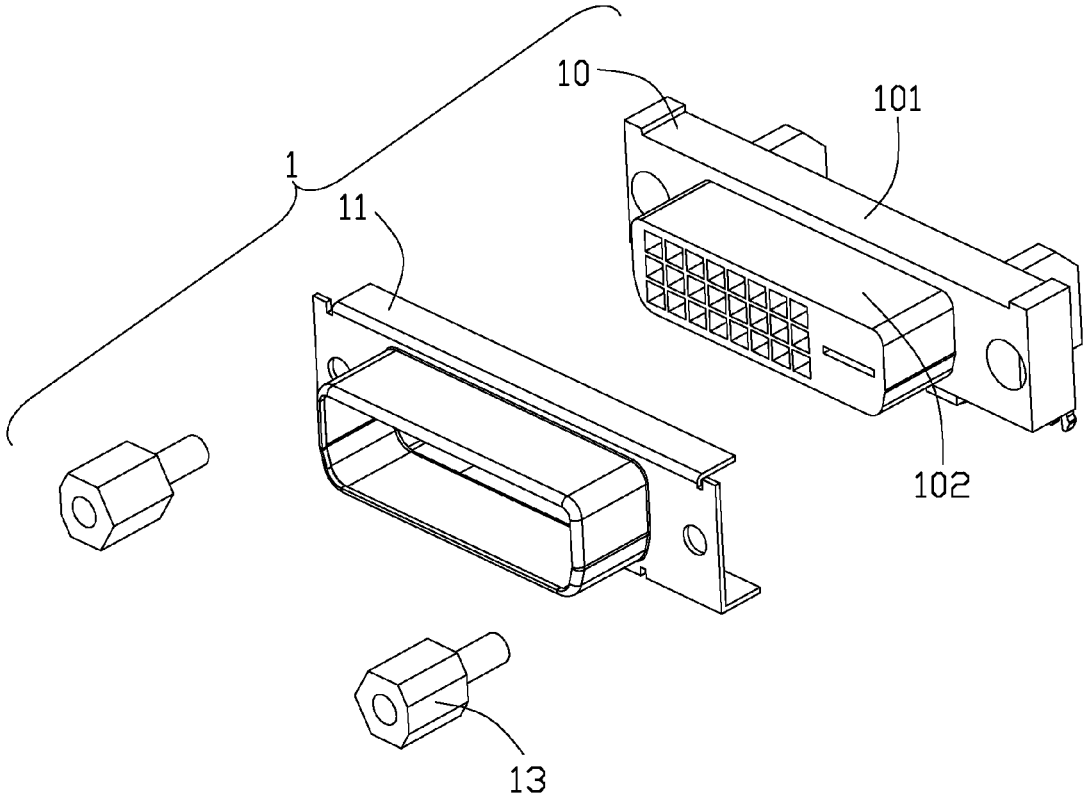
FIG. 4 is an exploded view of an electrical connector of the electrical cable connector assembly shown in FIG. 1.
Figure 5:
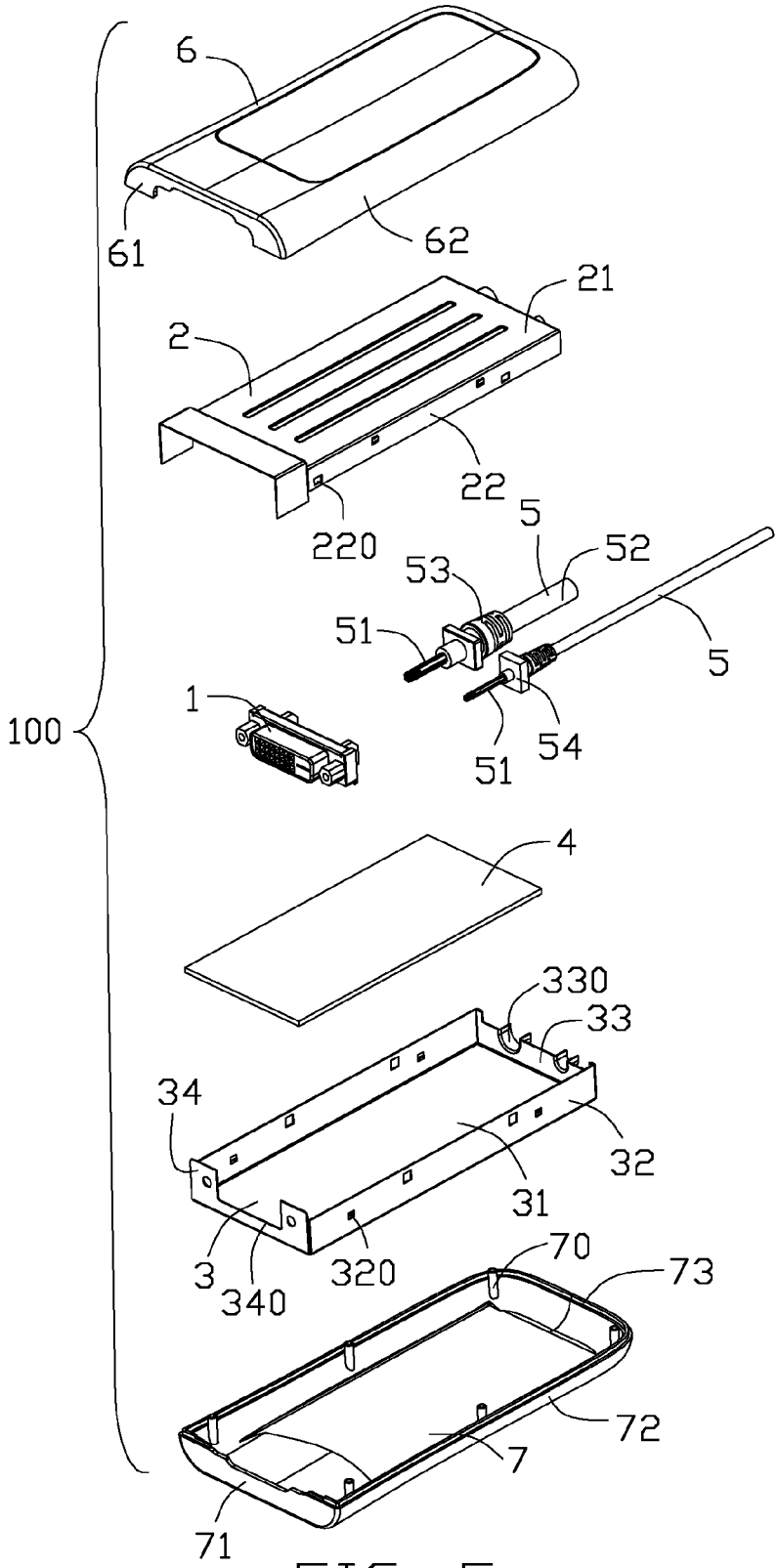
FIG. 5 is an exploded view of the electrical cable connector assembly shown in FIG. 1.
Figure 6:
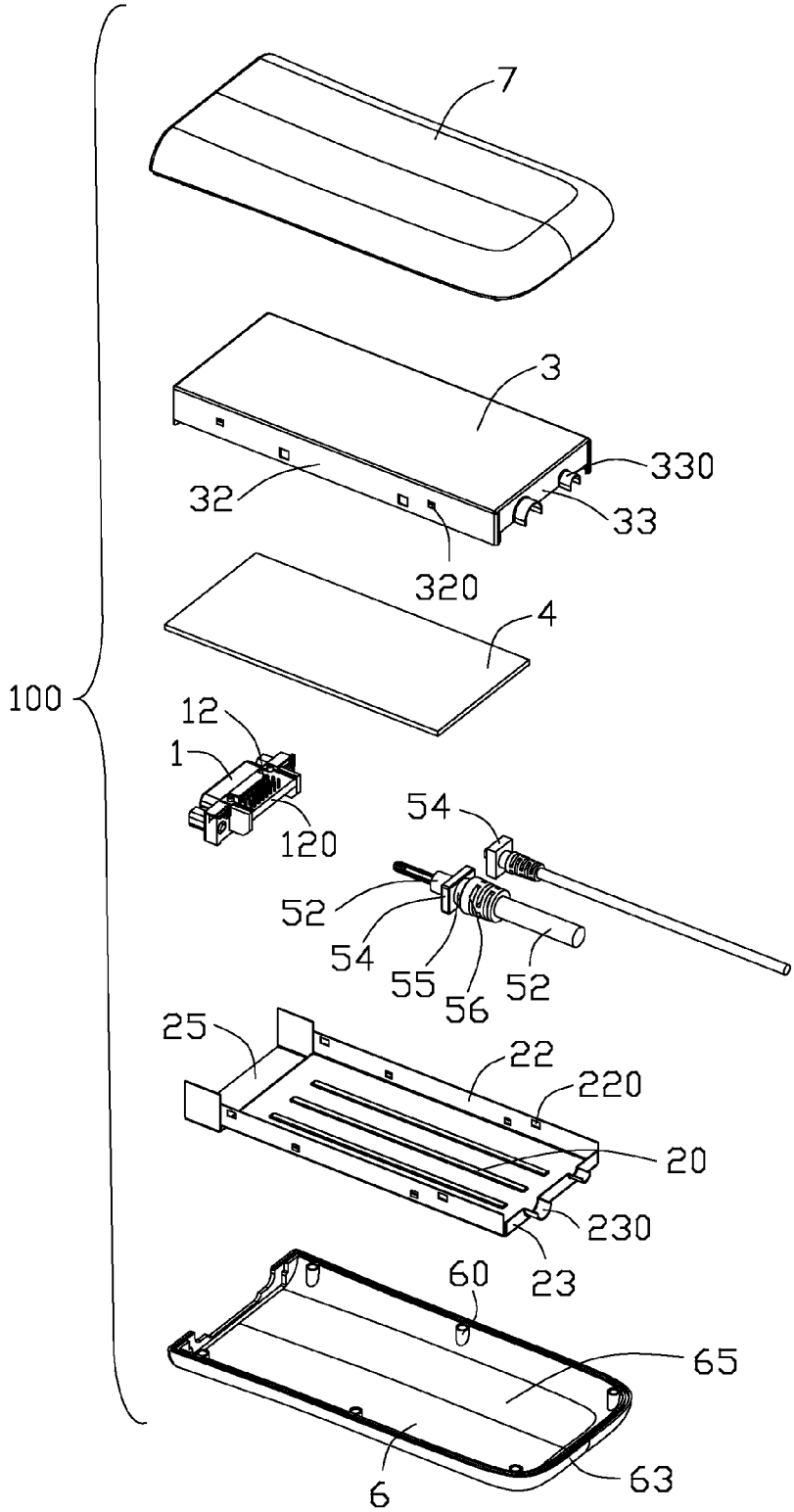
FIG. 6 is a view similar to FIG. 5, but viewed from a different aspect.

Please refer to FIGS. 1-6, an electrical cable connector assembly 100 in accordance with the preferred embodiment of the present invention, comprises an electrical connector 1, an upper metallic shell 2, a lower metallic shell 3 assemble with the upper shell 2, a printed circuit board (PCB) 4 connected between the cable 5 and the electrical connector 1, an upper cover 6 and a bottom cover 7 assembled to the upper cover 6 to enclose the upper shell 2 and the lower shell 3, and two cables 5 with different width and extending rearwardly out of the covers 6, 7.

The electrical connector 1 is a digital Visual Interface (DVI) connector, and comprises an insulative housing 10, a metallic shell 11 enclosing the insulative housing 100, a plurality of the contacts 12 retained in the insulative housing 10, and a pair of screw nuts 13 securing the shell 11 to the insulative housing 10. The insulative housing 10 includes a body portion 101, and a D-shaped mating portion 102 protruding forwardly from the body portion 101. The body portion 101 protrudes beyond the mating portion 102 both in an upper-to-lower direction and a transverse direction. The PCB 4 is located behind the electrical connector 1. The contacts 11 each defines a soldering tail 120 extending downwardly out of the insulative housing 10 to be soldered on a front end of the PCB 4.

The cables 5 each has a plurality of wires 51 soldered at a rear end of the PCB 4, an outer insulative polymer 52 enclosing the wires 51 and a strain relief portion 53 molded surround the insulative polymer 52. The strain relief portion 53 defines a rectangular shape retaining plate 54 disposed behind the PCB 4, an enlarged column 56, and an annular depression 55 formed therebetween. The insulative polymer 52 partly extends forwardly out of the retaining plate 54.

The upper shell 2 and the lower shell 3 both are stamped and formed from a metallic plate. The upper shell 2 and the lower shell 3 are assembled together and commonly define a receiving space 20 for accommodating the PCB 4 and a rear end of the electrical connector 1 therein. The upper shell 2 includes an upper horizontal wall 21, a first pair of vertical side walls 22 bending downwardly from two opposited sides of the upper wall 21, and a first rear wall 23 bending downwardly from a rear end of the upper wall 21. The first side walls 22 and the rear wall 23 are perpendicular to the upper wall 21. Each front end of the upper wall 21 and the side walls 22 are expanded outwardly to define an enlarged retaining space 25. The side walls 22 each defines a plurality of retaining holes 220. The rear wall 23 defines two upper half cable rings 230 deep drawn rearwardly from a bottom edge thereof. The upper half cable rings 230 have different radius.

The lower shell 3 includes a lower wall 31 opposited to the upper wall 21 of the upper shell 2, a second pair of side walls 32 bending upwardly from two opposite sides of the lower wall 31, a second rear wall 33 and a front wall 34 bending upwardly from a rear end and a front end of the lower wall 31 respectively. The second side walls 32, the rear wall 33 and the front wall 34 are perpendicular to the lower wall 31 respectively. The second side walls 32 each defines a plurality of retaining plates 320 retained into the retaining holes 220 of the first side walls 22 respectively for the upper shell 2 being retained with the lower shell 3 reliably. The first side walls 22 enclose the second side walls 32 respectively.

The front wall 34 defines an opening 340 passing therethrough and communicating with the receiving space 20 to allow the mating portion 102 of the electrical connector 1 to protrude forward out of the shells 2, 3 for mating with a complementary connector (not shown). The second rear wall 33 defines two lower half cable rings 330 deep drawn rearwardly from a top edge thereof. The lower half cable rings 330 each engages with the upper half cable ring 230 of the upper shell 2 to define a whole circle cable ring respectively.

The upper cover 6 and the bottom cover 7 are made of insulative material and have the same shape with each other. The upper cover 6 and the bottom cover 7 define a cavity 65 to retain the upper and lower shell 2, 3 and the PCB 4, a rear end of the electrical connector 1, and a front end of the cable 5. The upper cover 6 and the bottom cover 7 each defines a front wall 61, 71, and a rear wall 62, 72 opposited to the front wall 61, 71, a pair of side walls 63, 73. The upper cover 6 defines a plurality of tubular portions 60. The bottom cover 7 defines a plurality of post portions 70 retained into the tubular portions 60 respectively. The tubular portions 60 and the post portions 70 are disposed in the cavity 65. The upper shell 2 and the lower shell 3 are sandwiched between at least two tubular portions 60 or post portions 70 for being prevented from moving in the transverse direction. The upper shell 2 and the lower shell 3 are also sandwiched between the front walls 61, 71 of the cover 6, 7 and the tubular portion 60 or post portion 70 for being prevented from moving in front-to-rear direction.

When the electrical cable connector assembly 100 is in assembly, a front end of the insulative polymer 52 which is disposed at the front of the retain relief portion 53 is wholly enclosed by the upper half cable ring 230 and the lower half cable ring 330 is adapted to reduce EMI during signal transmission. The retaining plate 54 is sandwiched between the half cable rings 230, 330 and the rear walls 62, 72 of the covers 6, 7 for preventing the cable 5 from moving in the front-to-rear direction. The rear walls 62, 72 are retained in the depression 55 of the cable 5. The body portion 101 of the electrical connector 1 is located in the enlarged retaining space 25 of the upper shell 2 for being prevented from moving rearwardly. The front wall 34 abuts against the upper shell 2 and the lower shell 3 for preventing the shells 2, 3 from moving forwardly. The mating portion 102 protrudes out of the covers 6, 7 to exterior for mating with the complementary connector.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. An electrical cable connector assembly, comprising:

a metallic shell having an upper shell and a lower shell secured with the upper shell to define a receiving space therebetween, the upper shell having an upper rear wall around the receiving space, the lower shell having a lower rear wall around the receiving space;

an electrical connector retained in the receiving space, and including an insulative housing, and a plurality of contacts retained in the insulative housing; and a cable including a wire extending into the receiving space to electrically connect to the contacts, the cable extending rearwardly out of the shell;

wherein the upper rear wall and the lower rear wall each defines a half cable ring extending rearwardly therefrom, the two half cable rings are cooperated with each other to form a complete cable ring fully surrounding the cable, the two half cable rings do not overlap with each other in a radius direction thereof.

2. The electrical cable connector assembly as claimed in claim 1, wherein the cable ring presents as a tubular structure.

3. The electrical cable connector assembly as claimed in claim 1, further comprising an upper cover, and a lower cover assembled with the upper cover to define a cavity accommodating the upper shell and the lower shell therein.

4. The electrical cable connector assembly as claimed in claim 3, wherein the cable includes an outer insulative polymer surrounding the wire, the cable ring directly encloses the insulative polymer.

5. The electrical cable connector assembly as claimed in claim 4, wherein the upper shell includes an upper wall, and a first pair of side walls bending downwardly from two opposite sides of the upper wall, the rear wall bends downwardly from a rear end of the upper wall, the receiving space defines an enlarged retaining space defined by front ends of the upper wall and the side walls, the front ends of the upper wall and the side walls are expanded outwardly, the lower shell defines a bottom wall, a pair of side walls bending upwardly from two opposite sides of the bottom wall, a front wall opposited to the rear wall and enclosed the enlarged retaining space, the electrical connector includes a body portion retained in the enlarged retaining space for being prevented from moving along a front-to-rear direction, and a mating portion protruding forwardly to exterior from the body portion.

6. The electrical cable connector assembly as claimed in claim 5, wherein the side walls of the upper shell cover the side walls of the lower shell respectively, the side walls of the upper shell each defines a retaining hole, the side walls of the lower shell each defines a retaining plate retained into the retaining hole for the upper shell being retained with the lower shell reliably.

7. The electrical cable connector assembly as claimed in claim 5, wherein the upper cover and the bottom cover each defines a rear wall, the cable includes a strain relief portion defining a retaining plate sandwiched between the rear wall of the covers and the cable ring in the front-to-rear direction, the insulative polymer partly extends forwardly out of the retaining plate.

8. The electrical cable connector assembly as claimed in claim 7, wherein the strain relief portion has an enlarged column behind the retaining plated to define an annular depression therebetween, the rear walls of the upper cover and the bottom cover are retained in the depression respectively.

9. The electrical cable connector assembly as claimed in claim 8, wherein the upper cover defines a plurality of tubular portions, the bottom cover defines a plurality of post portions retained into the tubular portions respectively.

10. The electrical cable connector assembly as claimed in claim 9, wherein the upper shell and the lower shell are sandwiched between at least two tubular portions or at least two post portions for being prevented from moving in a transverse direction perpendicular to the front-to-rear direction, the upper cover and the bottom cover each defines a front wall abutting against the upper shell and the lower shell for prevented the upper shell and the lower shell from moving forwardly, respectively.

11. The electrical cable connector assembly as claimed in claim 1, wherein the electrical connector is a DVI connector.

12. An electrical cable connector assembly, comprising:

a metallic shell defining a receiving space, and a cable ring extending rearwardly and aparted from the receiving space;

an insulative cover defining a cavity accommodating the shell therein, and a rear wall enclosing the cavity;

an electrical connector having an insulative housing, and a plurality of contacts retained in the insulative housing, the insulative housing defining a body portion retained in one of the receiving space and the cavity, and a mating portion protruding forwardly out of the insulative cover from the body portion;

a cable including a plurality of wires, and a strain relief portion surrounding around the wires; and a printed circuit board retained in the receiving space, and mechanically and electrically connected between the wires and the contacts, respectively;

wherein the cable ring encloses the cable, the strain relief portion has a retaining plate sandwiched between the cable ring and the rear wall of the insulative cover for preventing the cable from moving along a front-to-rear direction.

13. The electrical cable connector assembly as claimed in claim 12, wherein the shell defines a rear wall enclosing the receiving space, the cable ring is deep drawn rearwardly from the rear wall and presents as a cylindrical shape.

14. The electrical cable connector assembly as claimed in claim 12, wherein the shell includes an upper shell and a lower shell assembled to the upper shell to define the receiving space, the upper shell and the lower shell each defines a rear wall enclosing the receiving space, the rear wall of the upper shell defines an upper half cable ring deep drawn rearwardly from a bottom edge thereof, the rear wall of the lower shell defines a lower half cable ring deep drawn rearwardly from a top edge thereof, the upper half cable ring and the lower half cable ring are cooperated with each other to form the cable ring.

15. The electrical cable connector assembly as claimed in claim 13, wherein the receiving space defines a enlarged retaining space defined by front ends of a pair of side walls of the upper shell, the lower shell defines a front wall opposited to the rear wall and enclosed the enlarged retaining space, the body portion is retained in the enlarged retaining space for being prevented from moving along the front-to-rear direction.

16. An electrical cable connector comprising:

an inner metallic shell including opposite first and second halves commonly defining a receiving space, each of said first and second halves defining a rear wall in a vertical direction with a half ring structure unitarily extending therefrom, via a drawing process, in a horizontal direction perpendicular to said vertical direction;

an insulative cover enclosing said shell;

an electrical connector received in the receiving space and secured to the shell; and at least one cable located behind and electrically connected to the connector, said cable including an outer jacket enclosed by a strain relief portion, said strain relief having a retaining plate located between the cover and the rear wall of the shell in said horizontal direction; wherein a section of said outer jacket, which is located in front of and proximate the retaining plate, is snugly received between said two half rings of said first and second halves for perfecting EMI (Electro-Magnetic Interference) shielding; wherein each of the first and the second halves further includes a pair of vertically extending side walls by two sides of the rear wall under condition that the side walls are not unitarily formed transversely with the rear wall.

17. The electrical cable connector as claimed in claim 16, wherein said two half rings commonly defines a complete ring structure for fully surrounding said section of the jacket of the cable.

18. The electrical cable connector as claimed in claim 17, wherein a printed circuit board is held in the receiving space by said shell, and the connector and the cable are respectively mechanically and electrically connected to opposite front and rear ends of the printed circuit board.

* * * * *